US006589925B1

(12) United States Patent
Binstock et al.

(10) Patent No.: US 6,589,925 B1
(45) Date of Patent: Jul. 8, 2003

(54) AUTOMATIC DISHWASHING DETERGENT TABLETS

(75) Inventors: Gary Benjamin Binstock, Basking Ridge, NJ (US); Bruce Cummings, New York, NY (US); Divaker Kenkare, Califon, NJ (US); Kevin Mark Kinscherf, Freehold, NJ (US); Steve Mark Phillips, Highland Park, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/045,579

(22) Filed: Mar. 20, 1998

(51) Int. Cl.[7] ..... C11D 17/04
(52) U.S. Cl. ..... 510/224; 510/141; 510/142
(58) Field of Search ..... 510/151, 152, 510/153, 154, 155, 156, 158, 159, 130, 137, 470, 438, 446, 440, 141, 142, 143, 220, 224; 134/22.19

(56) References Cited

U.S. PATENT DOCUMENTS 1,854,235 A * 4/1932 Stoddard ..... 510/108
3,557,003 A * 1/1971 Morris et al. ..... 252/90
5,133,892 A * 7/1992 Chun et al. ..... 252/90

* cited by examiner

*Primary Examiner*—Gregory E. Webb
(74) *Attorney, Agent, or Firm*—Michael J. McGreal

(57) ABSTRACT

A detergent tablet in order to be readily dispensed from the detergent dispenser of an automatic dishwasher should be of a generally elliptical shape to a modified generally elliptical shape. This is a shape where a cylinder having a rectangular cross-section contained within the tablet shape has a diagonal dimension that is a minimum for such a shape. This is a diagonal of a cross-section along the minor axis of the tablet. This shape can be defined by the equation:

$$\left(\frac{x}{a}\right)^p + \left(\frac{y}{b}\right)^p = 1$$

where 2*a* is the length of the major axis, 2*b* is the length of the minor axis, and p in an exponent having a value of between about 1.5 to about 25 extending to a shape where the sides disposed along the major axis are parallel and the sides defined by the minor axis have a defined radius. As the value of p increases, tablet shape becomes more elongated. Preferably the tablet has at least one beveled edge, and usually a plurality of beveled edges. The beveled edges may be of the same or differing dimensions. Further, the tablet preferably has a convex top and/or bottom surface. This detergent tablet can be comprised of a single layer or of multilayers of different components such as detergent, enzymes and bleach. A bleach layer usually will be an inner layer sandwiched between two detergent layers. Also, in a multilayer structure usually the layers will be of different colors.

20 Claims, 2 Drawing Sheets

AUTOMATIC DISHWASHING DETERGENT TABLETS

FIELD OF THE INVENTION

This invention relates to the shape of detergent tablets for automatic dishwashers. More particularly, this invention relates to tablets that can be positively dispensed from the dispensing holder of an automatic dishwasher upon the holder being activated.

BACKGROUND OF THE INVENTION

Detergent tablets have been developed for use with automatic dishwashers. In order to be positively dispensed into the washer tub each time that the detergent tablet holder is activated, the tablet has to be of a particular shape. This is the case since not all tablet shapes will be dispensed each time the detergent holder compartment is activated and opened. It is important that the tablet not interfere with the opening of the detergent holder and that it be dispensed down into the wash water in the wash tub. If left in the detergent holder compartment, the likelihood is that the tablet will only be partially dissolved. Only some of the detergent will get into the wash tub and be used to wash the dishes. The amount that remains in the holder will be wasted. The net result is that the dishes in most instances will not be effectively washed. Not all of the soils will be removed. There will be a residue soils layer on at least part of the surfaces of the dishes.

One reason that there is difficulty in the dispensing of tablets into the wash tub of an automatic dishwasher is that the detergent dispensers were designed for use with powder and gel detergents. Each of these will flow into the wash tube when the detergent holder is opened. Any residual amount in the detergent holder is quickly dissolved by the water being splashed in the wash tub. The detergent holder will be clean after each wash. However, when a detergent tablet hangs up in the detergent holder and not be dropped into the wash tub, it usually will be dissolved only partially.

The prior art of detergent tablet shapes is set out in several patents, one of which is U.S. Pat. No. 5,133,892. There is disclosed a cylindrical tablet having three concentric layers. This patent is directed to the timed release of the different concentric layers. The different substances of these concentric layers are released sequentially. In U.S. Pat. No. 3,557,003 there is disclosed a cylindrical tablet that has beveled edges. The tablet also has passages for the release of gas as wash water penetrates the tablet. U.S. Pat. No. 3,423,322 also discloses a cylindrical detergent tablet that has beveled edges. This tablet is stated to have a high compressive strength.

The problem that was confronted was to produce a dishwasher detergent tablet in a shape where it will be readily and positively dispensed from a detergent holder and into a dishwasher tub, and that will contain a high amount of detergent with regard to the dimensions of the tablet. Each time that the detergent holder opens, the tablet should fall into the water in the wash tub. This problem is increased due to the different size and shape detergent holders on different brands of automatic dishwashers. This problem is solved by the dishwasher detergent tablets of the present invention. It has been found that cylindrical, square and rectangular shaped tablets do not reliably fall into the wash tube from holder when the detergent holder is opened. The tablets of the present invention reliably fall from the detergent holder into the wash tub when the detergent holder of an automatic dishwasher is opened. This particularly is the case for General Electric automatic dishwashers.

SUMMARY OF THE INVENTION

This invention is directed to a dishwasher detergent tablet that has a shape that is readily dispensed from the detergent holder of an automatic dishwashing machine into the wash tub at the start of the wash cycle. The shape should be of a generally elliptical to a modified generally elliptical shape. This is an elliptical-like shape where the diagonal dimension of a rectangular cylinder contained within the generally elliptical to modified generally elliptical shape is a minimum. This is a cylinder of rectangular cross-section that has a maximum volume with respect to the volume of the tablet. The diagonal dimension is the diagonal of a rectangular cross-section along the minor axis. This further will aid in providing a non-stable shape for the detergent tablet. A generally elliptical shape can be one defined by the formula:

$$\left(\frac{x}{a}\right)^p + \left(\frac{y}{b}\right)^p = 1$$

where 2*a* is the length of the major axis, 2*b* is the length of the minor axis, and p in an exponent. The exponent p should be from about 1.5 to about 25 and preferably about 2 to about 20. This will produce a generally elliptical tablet. As the value of the exponent p increases, the generally elliptical shape approaches a modified generally elliptical elongated bar-like shape. In this latter shape the sides of the tablet along the major axis can be essentially parallel with sides along the minor axis curved, and preferably a compound curve.

In another preferred embodiment the edges of the tablet also are beveled. This increases the instability of the tablet in the detergent holder. Each edge can be beveled or only one or more edges can be beveled. Further, the bevel need not be of the same dimension fully around the tablet. The bevel on one or more sides of the tablet can be of a greater or lesser dimension. The objective is to have a shape that is not stable in the detergent holder. The shape should be such that the tablet tends to fall toward and into the wash tub upon the dispenser holder being activated.

In a further preferred embodiment at least one of the top surface and the bottom surface is convex in shape. Most preferably both the top surface and the bottom surface are convex in shape. Convex shapes will add to the instability of the tablet in the detergent dispenser. Such a shape also fits well into the detergent holder and does not interfere with the opening of the detergent holder.

The tablet can be a mixture of these features. It can be flat on a bottom surface and convex on a top surface. The particular design features are chosen to meet particular requirements.

The tablet can be of a single layer or of a multilayer structure. For instance the outer layer can be detergent and an inner layer can be a bleach. The detergent layer also can contain enzymes. When a bleach is a part of the tablet, preferably it is the inner layer sandwiched between two outer detergent layers. This is the case since a bleach layer has a tendency to absorb moisture and decrease in strength. It is protected when sandwiched between detergent layers. Further, a bleach can be harsh on hands, and since the tablet is to be handled, it is preferred that it can be in a configuration to minimize skin contact with the bleach component.

In an additional preferred embodiment the different layers of a multilayer tablet will be of different colors. This would assist in informing the user that the tablet is comprised of more than one component.

DETAILED DESCRIPTION OF THE INVENTION

Figure 1:
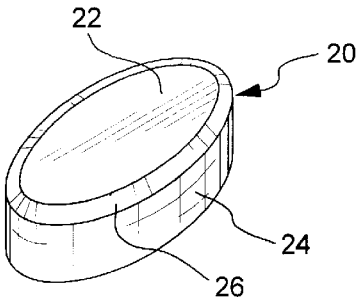
FIG. 1 shows an elliptical detergent tablet.

The invention is a particular shaped detergent tablet that can be readily and positively dispensed from the detergent holder of an automatic dishwashing machine. Detergent holders for automatic dishwashing machines are of varied shapes and sizes. In shape they range from rectangular to oval to circular. These detergent holders primarily are made to accommodate powder and gel detergents. Structurally they are not the optimum shape for dispensing tablet detergents. For all detergents they must hold the detergent and, at the proper time when the holder door opens, dispense the detergent into the wash tub. With powder or gel detergents most will flow out of the detergent holder once the door to the detergent holder opens. Any remaining powder or gel detergent is quickly solubilized by the splashing water. However, with a tablet if it is not dispensed into the wash tub when the door to the holder opens, a residue will remain in the detergent holder after the washing cycle. This detergent is wasted.

In order to be sure that the detergent tablet gets into the wash tub, some users do not use the detergent holder, but rather place the detergent tablet directly into the wash tub. However, in such an instance, most of the detergent is lost in the prewash rinse cycle and is not available during the later wash cycle. This is not a viable solution.

The detergent tablets should be of a shape where the diagonal dimension of a cross-section along the minor axis of a contained rectangular cylinder (the distance from a corner on the lower surface to the diagonally opposite corner on the upper surface) is a minimum for a given mass of a tablet. The rectangular cylinder has a rectangular cross-section and has a maximum volume with respect to the volume of the tablet. This will require a tablet major axis (length), minor axis (width) and thickness (height) to be chosen to minimize the length of the diagonal dimension of a contained rectangular cylinder. When the length of the diagonal dimension is at a minimum, the tablet will have a maximum instability in round to elliptical detergent tablet holders and the tablet will be dispensed from the detergent holder when the door to the holder opens.

The detergent tablets for automatic dishwashers usually will contain about 12 to 40 grams of detergent and other additives, and preferably about 16 to 30 grams. This will produce a tablet having good strength with a volume of about 12 cc to about 25 cc. The tablets typically are produced using a traditional high speed rotary press. The tablets are formed by compressing a powder between an upper and lower punch surrounded by a fixed die(mold). Such molds are known in the art of tablet making. The tablets are pressed at a pressure of about 5 to 15 metric tons. The tablets hen tested on a Schleuinger Model 60 Tablet Tester have a strength of bout 12 to 30 Kpa.

It has been formed that a generally elliptical shape extending to a modified generally elliptical shape is effective for a tablet to be dispensed into the wash tube. A generally elliptical shape has the formula:

$$\left(\frac{x}{a}\right)^p + \left(\frac{y}{b}\right)^p = 1$$

where 2*a* is the length of the major axis, 2*b* is the length of the minor axis, and p in an exponent. The exponent p should be from about 1.5 to about 25 and preferably about 2 to about 20. This will produce a generally elliptical tablet. As the value of the exponent p increases, the elliptical shape approaches an elongated bar-like shape which is defined here as a modified elliptical shape. In this latter modified elliptical shape the sides of the tablet along the major axis can be essentially parallel with curved sides along the minor axis. The curved sides are compound curved sides.

It has been found that rectangular cylindrical shapes and circular cylindrical shapes do not readily dispense from the detergent holder of an automatic dishwashing machine. These are tablets that are rectangular and circular in cross-section respectively.

Figure 2:
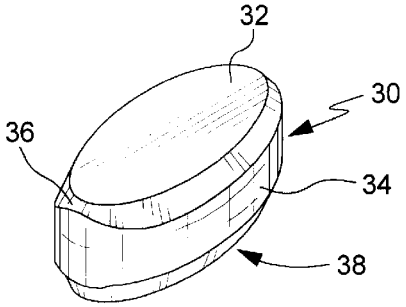
FIG. 2 shows an elliptical detergent tablet with varied bevel edges.

The generally elliptical shapes will be described with reference to the drawings. FIG. 1 shows a generally elliptical detergent tablet 20 having a vertical side surface 24 and planar top surface 22. There is a bevel 26 separating the side surface from the top surface. A beveled edge assists in the dispensing of the tablets into the wash tub. Beveled edges also reduce tablet breakage during tablet production and further handling. In FIG. 2 there is shown a modification of the tablet of FIG. 1. Here tablet 30 has side surface 34, top surface 32 and bottom surface 38. A bevel 36 of varying dimensions separates the side surface from the top surface and from the bottom surface.

Figure 3:
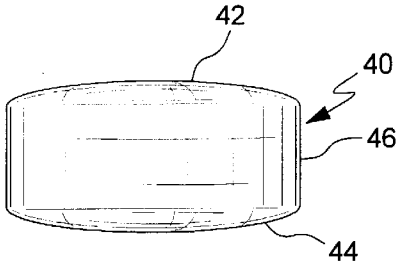
FIG. 3 shows an elliptical detergent tablet with convex shaped top and bottom surfaces.

FIG. 3 shows a detergent tablet 40 that has a side surface 46 and convex shaped top surface 42 and bottom surface 44. This shape has a high degree of instability in the detergent holder and is positively dispensed into the wash tube of automatic dishwashing machines.

Figure 4:
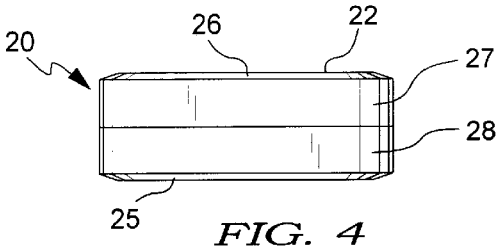
FIG. 4 shows a multilayer detergent tablet.

FIG. 4 shows the detergent tablet of FIG. 1 as a two layer tablet. This can be layers of different detergents or it can be a layer of a detergent and a layer of a bleach. In a preferred embodiment there is a layer of a detergent and/or enzymes and a layer of a bleach. The bleach can be a chlorine or oxygen bleach.

Figure 5:
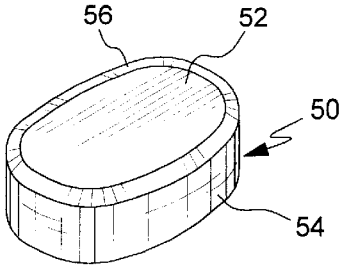
FIG. 5 shows a tablet with a modified elliptical shape with the beveled edges.
Figure 6:
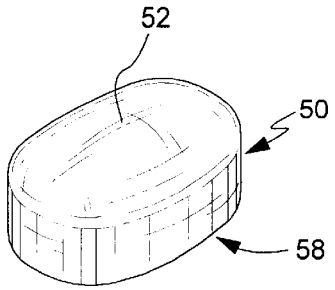
FIG. 6 shows the tablet of FIG. 5 with convex top and bottom surfaces.

FIG. 5 shows a modified elliptical shape. This is related to the tablet of FIG. 1. The tablet 50 has a side surface 54 and a top surface 52. A bevel 56 separates the top and bottom surfaces. FIG. 6 shows the same modified generally elliptical shape as FIG. 5, but with a convex top surface 52 and bottom surface 58 which is similar in shape to that of FIG. 3.

Figure 7:
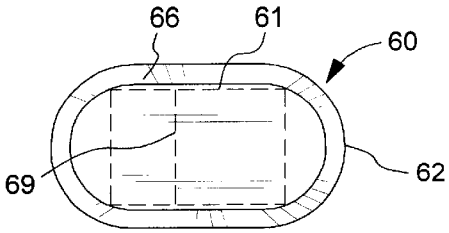
FIG. 7 shows a tablet with a further modified elliptical shape with beveled edges, parallel sides along the major axis and the diagonal of a contained rectangular cylinder.
Figure 8:
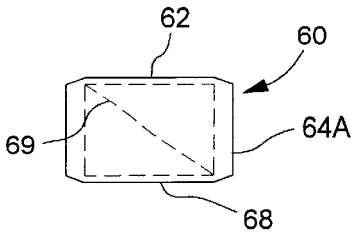
FIG. 8 shows the tablet of FIG. 7 in cross-section along the minor axis and the diagonal of a contained rectangular cylinder.
Figure 9:
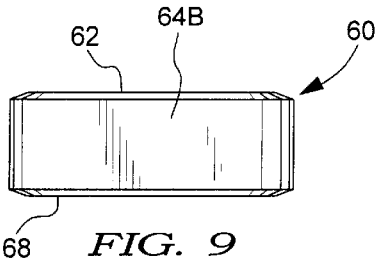
FIG. 9 shows the tablet of FIG. 7 in elevation on a side along the major axis.
Figure 10:
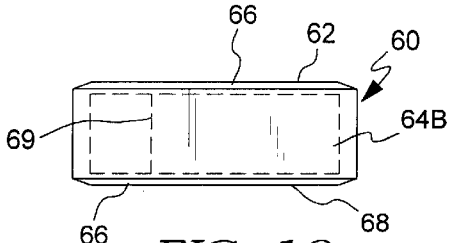
FIG. 10 shows the tablet of FIG. 7 in a side elevation along the major axis.

FIG. 7 shows a further modified, generally elliptical tablet shape. This tablet 60 has a minor axis side wall 64A and a major axis side wall 64B and a top surface 62. Bevel 66 separates the top surface and the side wall. Shown in this view in dashed lines is a contained rectangular cylinder 61. It is the diagonal dimension 69 (see FIGS. 8 and 10) of this contained rectangular cylinder that should be minimized. In FIG. 8 this tablet is shown in a cross-sectional view along the minor axis. The diagonal 69 is the diagonal of a cross-section of the contained rectangular cylinder 61. In FIG. 9 there is shown a side elevation view along the major axis. As shown the side walls are parallel along a major portion of the major axis.

Figure 11:
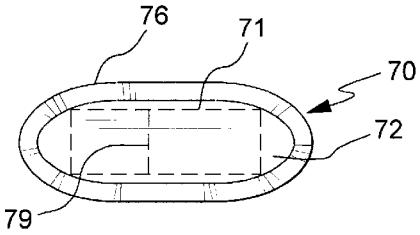
FIG. 11 shows a tablet with a further modified elliptical shape with beveled edges and parallel sides along the major axis and the diagonal of a contained rectangular cylinder.
Figure 12:
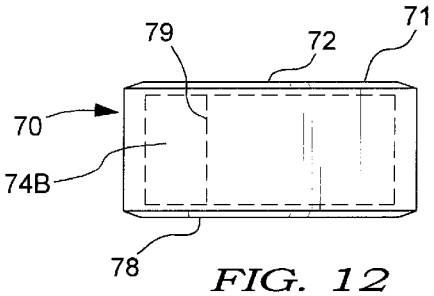
FIG. 12 shows the tablet of FIG. 11 in elevation on a side along the major axis.
Figure 13:
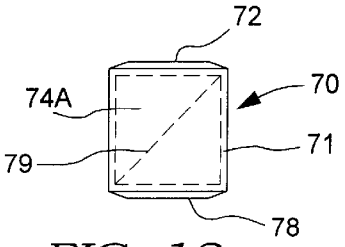
FIG. 13 shows the tablet of FIG. 11 in elevation on a side along the minor axis.

In FIG. 11 there is shown a yet further modified elliptical shape for the detergent tablets. Tablet 70 has top surface 72 and a bevel 76. Contained within the tablet and shown in dashed lines is contained rectangular cylinder 71. Also shown is diagonal 79 of a cross-section of the contained rectangular cylinder 71. FIG. 12 is a side elevational view of this tablet along the major axis. There is shown in this view the side surface 74*b* along the major axis and bottom surface 78. Also shown is diagonal dimension 79 of the cross-section of the contained rectangular cylinder. In FIG. 13 there is shown a side elevational view of the tablet of FIG. 11 along the minor axis showing diagonal 79. Also shown is the contained rectangular cylinder 71. The diagonal dimension of the tablet of FIG. 11 is as minimum as is that of the tablet of FIG. 7.

Figure 14:
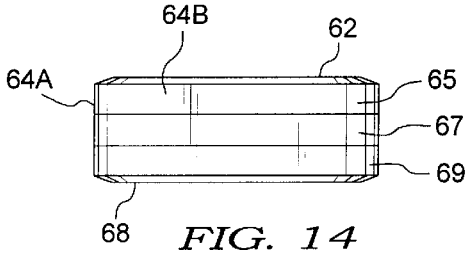
FIG. 14 shows the tablet of FIG. 7 in a three layer structure.

In FIG. 14 the tablet of FIG. 7 is shown as a three layer tablet. These are layers 65, 67 and 69. These layers can be the same material or different materials. It is preferred that they be of different materials. In a preferred arrangement, layer 67 will be a bleach composition and layers 65 and 69 will be detergent and/or enzyme compositions. It is preferred that the bleach be a center layer since it is susceptible to picking up moisture with a weakening of the tablet and a loss of active ingredients. The bleach can be a chlorine or oxygen bleach Also, such a layer arrangement will minimize skin contact with the bleach when the tablet is being handled. In addition the different layers will usually be of different colors. Essentially, any detergent compositions that can be tableted can be used. Many such compositions are known in the art. Likewise, the bleach can be any composition that can be formed into a tablet. Many such compositions are known in the art.

Figure 15:
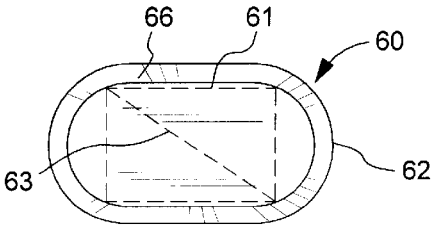
FIG. 15 is a top plan view of the tablet of FIG. 7 showing a diagonal of the rectangular cylinder contained in the tablet.
Figure 16:
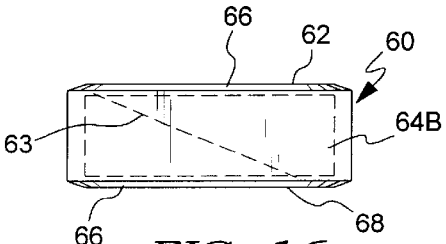
FIG. 16 is a side elevational view of the tablet of FIG. 7 showing the diagonal dimension of the rectangular cylinder contained in the tablet.

FIG. 15 illustrates another dimension that is of importance in the shape of the tablets. This is a diagonal 63 extending in relation to the major axis from a bottom corner of the contained rectangular cylinder to a top corner of the contained rectangular cylinder. This is shown in more detail in FIG. 16. This diagonal dimension also should be a minimum in order to increase the instability of the tablet to insure that it will be dispensed into the wash tub.

In a useful embodiment the composition of a single layer detergent tablet can have approximately the following composition by weight:

a) 20% to 40% of an alkali metal phosphate detergent builder salt;

b) 10% to 24% of a dialkali metal disilicate;

c) 16% to 26% of an alkali metal carbonate;

d) 8% to 14% of an alkali metal metasilicate;

e) 0.1% to 6% of a low-foaming nonionic surfactant;

f) 0.5% to 5% of a polymer containing sulfonic acid groups;

g) 0.2% to 5% of a chlorine bleach compound;

h) 0.1% to 1% of a hydrotrope; and i) 0% to 10% of a clay, wherein the clay can contain a dye which imparts a colored speckle appearance to the tablet.

The shaped tablet when comprised of three layers where the tablet comprises a bottom layer, a middle layer and a top layer, the bottom layer is about 15 wt. % to 25 wt. % of the total weight of the tablet, the middle layer is about 40 wt. % to 50 wt. % of the total weight of the tablet and the top layer is about 30 wt. % to 40 wt. % of the total wt. % of the tablet. The bottom layer comprises approximately by weight of the total weight of the bottom layer:

a) 20% to 40% of an alkali metal phosphate detergent builder salt;

b) 10% to 24% of a dialkali metal disilicate;

c) 16% to 26% of an alkali metal carbonate;

d) 16% to 24% of an alkali metal metasilicate;

e) 0.1% to 6% of a low-foaming nonionic surfactant;

f) 0.5% to 5% of a polymer containing sulfonic acid groups;

g) 0.1% to 1% of a hydrotrope; and h) 0.1% to 1% of a pigment; and the middle layer comprises approximately by weight of the total weight of the middle layer;

a) 20% to 40% of an alkali metal phosphate detergent builder salt;

b) 10% to 24% of a dialkali metal disilicate;

c) 16% to 26% of an alkali metal carbonate;

d) 8% to 14% of an alkali metal metasilicate;

e) 0.1% to 6% of a low-foaming nonionic surfactant;

f 0.5% to 5% of a polymer containing sulfonic acid groups;

g) 5% to 10% of a chlorine bleach compound; and h) 0.1% to 1% of a hydrotrope; and and the top layer comprises approximately by weight of the total weight of the top layer;

a) 20% to 40% of an alkali metal phosphate detergent builder salt;

b) 10% to 24% of a dialkali metal disilicate;

c) 16% to 26% of an alkali metal carbonate;

d) 16% to 24% of an alkali metal metasilicate;

e) 0.1% to 6% of a low-foaming nonionic surfactant;

f) 0.5% to 5% of a polymer containing sulfonic acid groups;

g) 0.1% to 1% of a hydrotrope; and h) 0.1% to 1% of a pigment.

The detergent tablets of these designs readily fall from the detergent holder into the wash tub. The shape are unstable in the detergent holder and readily fall into the wash tub. This particularly is the case for circular shaped detergent holders such as those of General Electric automatic dishwashing machines. The reliability of falling into the wash tub for these tablet shapes approaches 100%.

| SHAPE | WEIGHT (gm) | VOLUME ($cm^3$) | DENSITY (g/cc) | DIAGONAL (mm) | % DISPENSED WASH CYCLE | % DISPENSED 2ND RINSE CYCLE |
|---|---|---|---|---|---|---|
| Rectangular (commercial product) | 24 | 16.0 | 1.50 | 31.6 | 0 | 0 |
| FIG. 2 Tablet | 25 | 14.7 | 1.70 | 29.4 | 95 | 5 |
| FIG. 5 Tablet | 25 | 14.7 | 1.70 | 27.7 | 90 | 10 |
| FIG. 9 Tablet | 25 | 14.7 | 1.70 | 26.7 | 100 | 0 |

What is claimed is:

1. A detergent tablet for use in an automatic dishwashing machine, said tablet having an elliptical-like three-dimensional shape wherein a cylinder having a rectangular cross-section contained within said three-dimensional shape, having a maximum volume with respect to the volume of said three-dimensional shape, the corners of said rectangular cylinder contacting said three-dimensional shape, has a diagonal dimension in a cross-sectional plane across the minor dimension of said cylinder that is a minimum for a given mass of such a three-dimensional shape and has a diagonal dimension for a cross-sectional diagonal plane through said cylinder that is a minimum for said three-dimensional shape.

2. A detergent tablet as in claim 1 wherein said shape extending from a generally elliptical shape is defined by the formula:

$$\left(\frac{x}{a}\right)^p + \left(\frac{y}{b}\right)^p = 1$$

where 2*a* equals the length of the major axis and 2*b* equals the length of the minor axis, the exponent p being in the range of about 1.5 and about 25 to a shape wherein the side edges of the tablet along the major axis are essentially parallel and the end edges along the minor axis are curved with a defined radius.

3. A detergent tablet as in claim 2 wherein said tablet has a major axis of about 2.5 cm to about 7 cm, a minor axis of about 1.5 cm to about 4 cm and a height of about 0.75 cm to about 2.5 cm.

4. A detergent tablet as in claim 3 wherein said tablet has a major axis of about 3 cm to about 6 cm, a minor axis of about 2 cm to about 4 cm and a height of about 0.75 cm to about 1.5 cm.

5. A detergent table as in claim 3 wherein at least one edge transitioning from a surface of said tablet defined by said major axis and said minor axis to a side surface defined by the height of said tablet has a bevel on at least a part of said edge.

6. A detergent tablet as in claim 5 wherein said bevel extends fully around said edge.

7. A detergent tablet as in claim 6 wherein said bevel is a different dimension on at least a part of said edge defined by the major axis of the tablet shape.

8. A detergent tablet as in claim 5 wherein each edge transitioning from an edge defined by said major axis and said minor axis to said side surface contains a bevel.

9. A detergent tablet as in claim 8 wherein each said bevel extends fully around each of said edges.

10. A detergent tablet as in claim 9 wherein said bevel is a different dimension on at least a part of said edge defined by the major axis of the tablet shape.

11. A detergent tablet as in claim 2 wherein at least one surface defined by said major axis and said minor axis is convex in shape.

12. A detergent tablet as in claim 11 wherein each surface defined by said major axis and said minor axis is convex in shape.

13. A detergent tablet as in claim 5 wherein at least one surface defined by said major axis and said minor axis is convex in shape.

14. A detergent tablet as in claim 13 wherein each said surface defined by said major axis and said minor axis is convex in shape.

15. A detergent tablet as in claim 2 wherein said detergent tablet is comprised of at least two layers.

16. A detergent tablet as in claim 15 wherein each layer has a minor axis and a major axis substantially the same as said tablet, and the sum of a side dimension of all of said layers equals the height of said tablet.

17. A detergent tablet as in claim 16 wherein there are at least three layers, an inner layer and two outer layers, said inner layer affected by moisture.

18. A detergent tablet as in claim 17 wherein said inner layer is a bleach layer.

19. A detergent tablet as in claim 18 wherein at least one layer is of a different color.

20. A detergent tablet as in claim 2 wherein said tablet has a shape wherein the sides of said tablet on the major axis thereof are parallel and the sides of said tablet on the minor axis have compound curves.

* * * * *